United States Patent [19]

Küker et al.

[11] Patent Number: 4,632,039

[45] Date of Patent: Dec. 30, 1986

[54] GUIDED CENTRAL GANTRY FOR RAILROAD PASSOVER PROTECTION

[75] Inventors: Wolfgang Küker; Heinz Findeklee, both of Salzgitter, Fed. Rep. of Germany

[73] Assignee: Linke-Hofmann-Busch GmbH, Fed. Rep. of Germany

[21] Appl. No.: 726,058

[22] Filed: Apr. 23, 1985

[51] Int. Cl.[4] ..... B61D 17/22; B61D 17/14; B61D 17/02

[52] U.S. Cl. ..... 105/801; 105/458

[58] Field of Search ..... 105/8 R, 12, 13, 15, 105/21, 22, 458; 293/107, 108, 110

[56] References Cited

U.S. PATENT DOCUMENTS 487,776 12/1892 Rosa ..... 105/8 R
4,252,065 2/1981 Bickel et al. ..... 105/8 R X
4,539,912 9/1985 Hassel et al. ..... 105/15 X

FOREIGN PATENT DOCUMENTS 2457634 6/1976 Fed. Rep. of Germany ..... 105/8 R

*Primary Examiner*—Robert B. Reeves
*Assistant Examiner*—Scott H. Werny
*Attorney, Agent, or Firm*—McGlew and Tuttle

[57] ABSTRACT

In a train formation, the passage from one car to the next is surrounded by a passover protection which comprises a central gantry closed on all sides which is mounted laterally displaceable relative to the cars. The central gantry is a mirror symmetric arrangement, even with the vehicle sides, consisting of adapter frames with peripheral abutments contacting elastic, hollow sections located peripherally between the abutments and the matching ends of the vehicle for small movement. A second set of peripheral, elastic hollow sections, structured for larger movement, is connected to the inner ends of the adapter frames and to the coupling frames. Connecting linkages are provided for guiding the adapter frames relative to the vehicles.

13 Claims, 4 Drawing Figures

GUIDED CENTRAL GANTRY FOR RAILROAD PASSOVER PROTECTION

FIELD AND BACKGROUND OF THE INVENTION

The invention relates to a guided central gantry consisting of two similar, mirror symmetrically arranged, detachably connected parts, for passover protection between two vehicles articulatedly connected together, in particular rail vehicles, where the central gantry, closed on all sides and mounted for lateral displacement relative to the vehicles, is aligned on a straight track, with the delimiting profile of the vehicles.

German Patent Application DE-OS No. 32 33 794 disclosed a passover protection structure therein flush with the shell of the rail vehicles. The structure includes central buffer couplings and comprises a central gantry closed on all sides and aligned in the straight track position, where the separating surface between the car end and the central gantry corresponds to a part of the surface of a sphere and a predetermined gap is covered by an elastic seal. The central gantry consists of two similar parts which are detachably connected together in the coupling plane, and it is connected with the central buffer coupling. Since, as is known, each central buffer coupling is provided with a sprung traction and impact device for the absorption of longitudinal forces, which device must absorb the longitudinal forces, the spring excursion required therefor is provided as the distance between the car and the central gantry, the gap thus resulting being covered by an elastic seal. This elastic seal, therefore, has the function both of securely sealing the gap between the car and the central gantry during lateral displacements of the central gantry and of absorbing the distance changes between car and central gantry deriving from the central buffer coupling. The elastic seal must therefore be dimensioned so that the necessary path (distance) is available as the central buffer coupling contracts or expands. The necessary strength against pressure impacts e.g. when trains meet or when traveling through tunnels can not always be ensured thereby. Also, during expansion of the coupling spring the seal system may open, so that seal against environmental influences no longer exists.

SUMMARY OF THE INVENTION

The problem underlying the invention is to provide, for a passover protection, a central gantry which eliminates the above described disadvantages and where under all occurring relative movements in the gangway area, the required compressive strength of the seal and the seal against environmental influences always exist.

BRIEF DESCRIPTION OF THE DRAWINGS

An embodiment of the invention is explained more specifically in the drawings, in which.

DESCRIPTION OF THE PREFERRED EMBODIMENT

Figure 1:
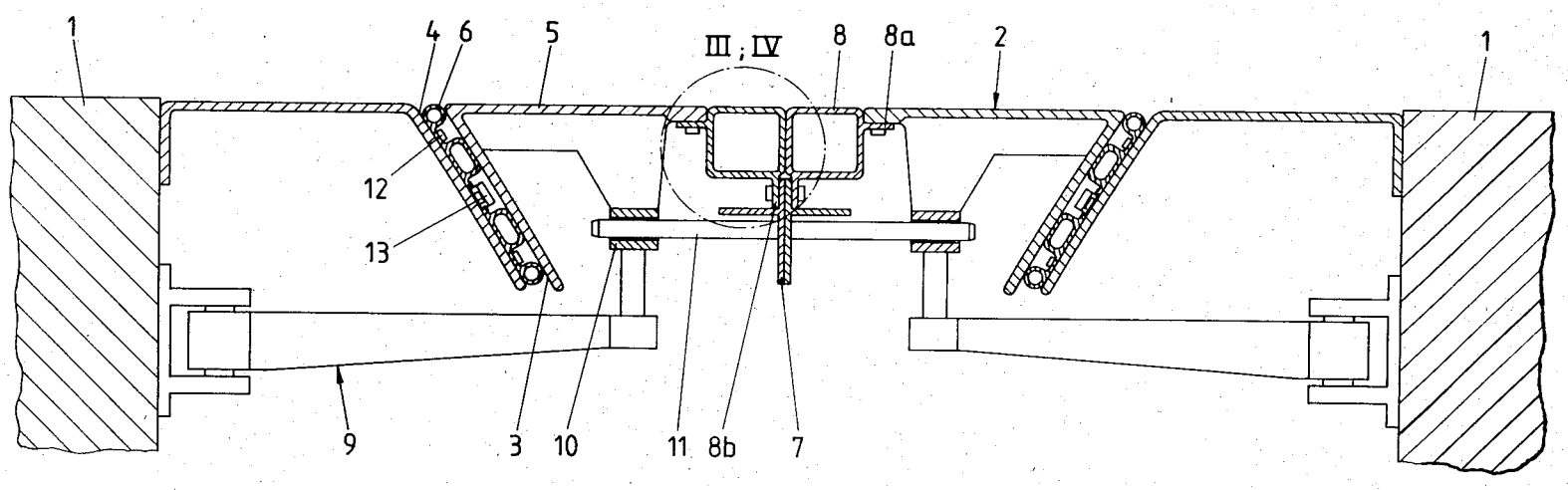
FIG. 1 shows the central gantry in the arrangement between two vehicles, in a section through the vertical longitudinal plane of the vehicle.
Figure 2:
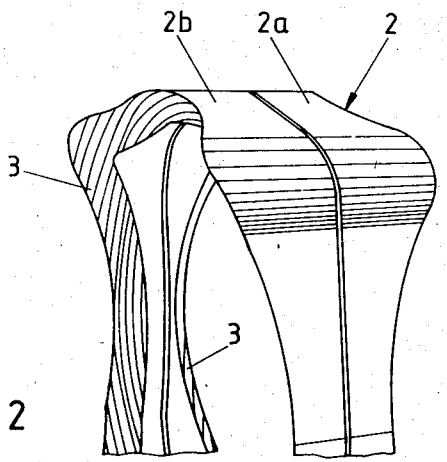
FIG. 2 is a basic representation of the central gantry in a perspective side view, the lower end being broken away, and on a smaller scale from that of FIG. 1.

The peripheral central gantry 2 arranged at the ends of the vehicles 1 of a train formation, consists advantageously of two similar, mirror symmetrically arranged parts 2*a*, 2*b* detachably connected together, and its outer contour is adapted to that of the vehicles 1. When vehicles 1 are on a section of straight track, the outer contour of gantry 2 is parallel to and even with the outer contour of the vehicles 1. Gantry 2 covers the sides and top of a passover between vehicles 1. On the sides toward the ends of the vehicles 1, the central gantry 2 carries a peripheral abutment 3, the contour and surface of which is formed in accordance with the ends of the cars 1. Each abutment 3 extends inwardly and at an angle. The contact surface 4 for the abutment 3 may, for example, be formed as part of the surface of a sphere whose center lies on the median longitudinal axis of the vehicles 1 and may have a peripheral inclination to the delimiting profile. The two similar parts 2*a*, 2*b* of the central gantry 2 each consist of an adapter frame 5 which by its abutment 3 is adapted to the associated vehicle 1 and which is sealed relative to the end of the vehicle 1 by a peripheral elastic hollow section 6, and of a coupling frame 7 guided for movement relative to the adapter frame 5, there being arranged between the adapter frame 5 and the coupling frame 7 a peripheral elastic hollow section 8 flush with the shell or outer contour of frame 5 (and thus gantry 2).

Through a linkage or connecting means 9 the adapter frame 5 is guided relative to the vehicle 1 on a predetermined path. In the longitudinal direction of the vehicle, the adapter frame 5 has arranged in it bushings 10 in which bars 11 are guided, at whose ends the coupling frame 7 is secured. The sealing hollow section 6 is secured either on the contact surface 4 or on the abutment 3, preferably by screws 12. In the hollow section 6 buffer elements 13 are arranged, their buffer surfaces being recessed relative to the seal surface of the sealing hollow section 6. The hollow section 8 is, for example, of square cross-section, one face being parallel to the outer contour of the vehicles 1 and terminating flush with it. On the outside of the hollow section 8, flanges 8*a*, 8*b* are arranged, which are connected with the adapter frame 5 and coupling frame 7, respectively. The outer delimiting profile of the coupling frame 7 extends parallel to the delimiting profile of the vehicles 1 offset inwardly by the width of the hollow section 8.

During relative lateral motions of the vehicles 1, the abutment 3 of the central gantry 2 is held and guided by the linkage 9 at the same distance from the contact surface 4. Hence the hollow profile section 6 sealing this distance has no distance changes to compensate and therefore can be laid out with the required strength against compressive impacts. Buffer elements 13 disposed inside the sealing hollow section 6 ensure sufficient emergency running properties, e.g. in case of track deviations of the linkages 9.

Figure 3:
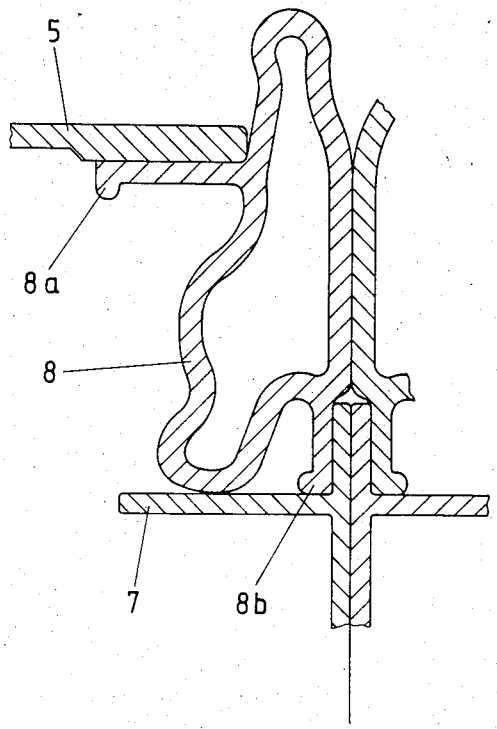
FIG. 3 is an enlarged detailed view of area III in FIG. 1 at maximum elastic contraction of the traction and impact device of the central buffer coupling.
Figure 4:
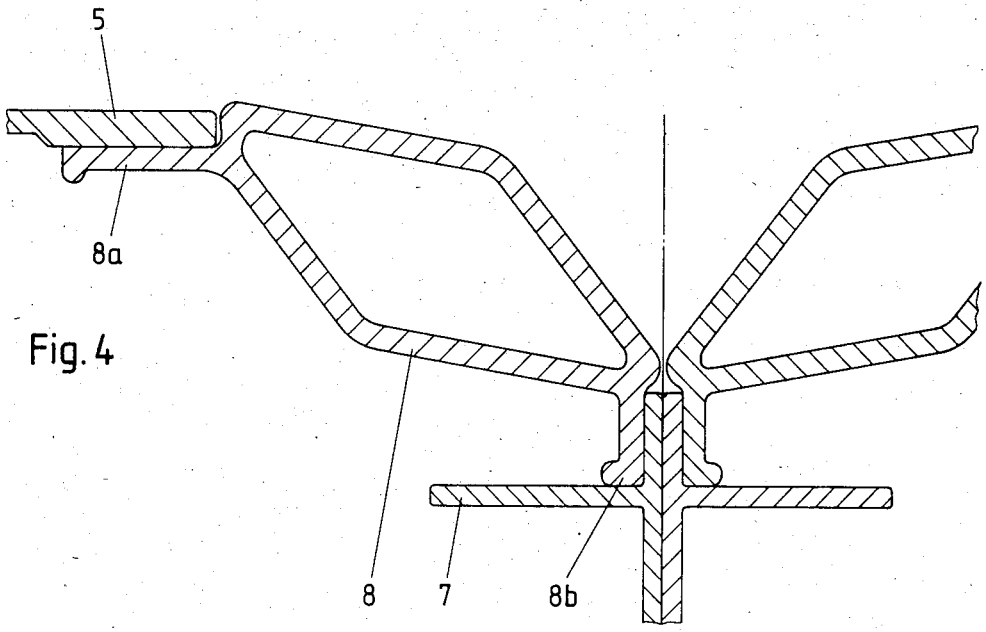
FIG. 4 is an enlarged detailed view of area IV in FIG. 1 (same as area III), at maximum deflection of the traction and impact device.

Distance variations between the vehicles 1, caused by contraction or expansion of the central buffer couplings, are elastically absorbed by the hollow section 8 between the adapter frame 5 and coupling frame 7 by elastic deformation, as illustrated in FIG. 3 and FIG. 4. The coupling frame guided relative to the adapter frame 5 in the longitudinal direction of the vehicle then supports the hollow section 8 and forms the contiguous surface for the two parts 2*a*, 2*b* of the central gantry 2. The sealing action of the sealing hollow section 6 and of the hollow section 8 can be adapted to the requirements by pressurization with compressed air.

What is claimed is:

1. A guided central gantry arrangement for a passover between two vehicles that are articulatedly connected to each other and which have facing end surfaces and outer contours at their sides and top, comprising:

a pair of mirror symmetrical gantry parts each extending around the sides and top of the passover for closing the passover, each gantry part having an adapter frame with an outer contour which is parallel to and even with the outer contour of the vehicles when the vehicles are in a straight line relationship with each other;

connecting means connected between each gantry part and one of the vehicles for mounting each gantry part to its respective vehicle for lateral displacement;

a pair of first elastic peripherally sealing hollow sections, each first hollow section engaged between one of said adapter frames and one of the vehicle end surfaces;

a coupling frame mounted for relative movement to and between said adapter frames in a direction parallel to the straight line direction of the vehicles;

a pair of second elastic peripherally sealing hollow sections, each second hollow section being connected between one of said adapter frames and said coupling frame;

said first and second hollow sections each extending around the sides and top of the passover, said first hollow section being structured for a relatively small amount of movement between said adapter frames and the vehicle end faces for establishing a strong seal with respect to an outside of the passover between said adapter frames and the vehicles, said second hollow sections being structured for a relatively large amount of movement between said coupling frame and said adapter frames.

2. A gantry arrangement according to claim 1, wherein each of said pair of second hollow sections has at least a portion which extends parallel to and even with the outer contours of said adapter frames when the vehicles are in straight line relationship with each other.

3. A gantry arrangement according to claim 1, wherein each adapter frame includes a peripheral abutment extending inwardly of the outer contour of the adapter frame, the end surfaces of each vehicle extending inwardly and substantially parallel to each respective abutment, said first pair of hollow sections being fixed to one of said abutment and the end surface of the vehicle and having a width corresponding to a space between said abutment and the end surface of the vehicle, and including a buffer element fixed to one of said abutment and the end surface of the vehicle and having a width less than a width of said first hollow section for limiting an amount which said first hollow section can be squeezed between said abutment and the end surface of the vehicle.

4. A gantry arrangement according to claim 1, wherein each of said pair of first and second hollow sections contain pressurized air.

5. A gantry arrangement according to claim 2, wherein each of said second hollow sections has a rectangular cross section taken on a plane extending parallel to a direction of travel for the vehicles, said rectangular cross section having one face extending parallel to and even with said outer contours of said adapter frames when the vehicles are in a straight line relationship with each other.

6. A gantry arrangement according to claim 5, wherein said coupling frame includes portions which extend parallel to a direction of travel for the vehicles, the rectangular cross section of each second hollow section having a further face which extends transversely to the outer contour of the adapter frames with the vehicles in a straight line relationship and which is deformable into engagement with one of said portions of said coupling frame when the adapter frames are moved close to each other, said portions of said coupling frame being parallel to and spaced inwardly from said contours of said adapter frame.

7. A gantry arrangement according to claim 6, wherein each of said second hollow sections has a pair of flanges connected at opposite corners of said rectangular cross section, one flange being connected to said coupling frame and the other flange being connected to one of said adapter frames.

8. A gantry arrangement according to claim 7, wherein said flanges extend perpendicularly to each other, said flanges connected to said adapter frames extending parallel to said contours of said adapter frames.

9. A gantry arrangement according to claim 5, wherein each adapter frame includes a peripheral abutment extending inwardly of the outer contour of the adapter frame, the end surfaces of each vehicle extending inwardly and substantially parallel to each respective abutment, said first pair of hollow sections being fixed to one of said abutment and the end surface of the vehicle and having a width corresponding to a space between said abutment and the end surface of the vehicle, and including a buffer element fixed to one of said abutment and the end surface of the vehicle and having a width less than a width of said first hollow section can be squeezed for limiting an amount which said first hollow section between said abutment and the end surface of the vehicle.

10. A gantry arrangement according to claim 9, wherein each of said pair of first and second hollow sections contain pressurized air.

11. A gantry arrangement according to claim 10, wherein said coupling frame includes portions which extend parallel to a direction of travel for the vehicles, the rectangular cross section of each second hollow section having a further face which extends transversely to the outer contour of the adapter frames with the vehicles in a straight line relationship and which is deformable into engagement with one of said portions of said coupling frame when the adapter frames are moved close to each other, said portions of said coupling frame being parallel to and spaced inwardly from said contours of said adapter frame.

12. A gantry arrangement according to claim 11, wherein each of said second hollow sections has a pair of flanges connected at opposite corners of said rectangular cross section, one flange being connected to said coupling frame and the other flange being connected to one of said adapter frames.

13. A gantry arrangement according to claim 12, wherein said flanges extend perpendicularly to each other, said flanges connected to said adapter frames extending parallel to said contours of said adapter frames.

* * * * *